United States Patent [19]

Corbin, Jr. et al.

[11] Patent Number: 4,863,309

[45] Date of Patent: Sep. 5, 1989

[54] METHOD OF REMOVING PAVEMENT MARKING MATERIALS FROM ASPHALT SURFACES

[76] Inventors: Maxwell H. Corbin, Jr., 6234 Deeside Dr., Dublin, Ohio 43017; Peter D. Butler, 2063 W. La. Ave., Columbus, Ohio 43221

[21] Appl. No.: 281,615

[22] Filed: Dec. 9, 1988

[51] Int. Cl.[4] ..... E01C 7/06

[52] U.S. Cl. ..... 404/77; 404/79; 156/344

[58] Field of Search ..... 404/77, 79; 156/344, 156/584, 155, 247; 126/271.2 A

[56] References Cited

U.S. PATENT DOCUMENTS 4,584,044 4/1986 Tokunaga et al. ..... 404/77 X

*Primary Examiner*—William P. Neuder

*Attorney, Agent, or Firm*—John L. Gray

[57] ABSTRACT

A method of removing pavement marking materials on an asphalt surface which comprises heating the surface of the asphalt roadway in which the pavement marking materials have been installed to a temperature just below that at which the pavement marking materials will liquify using an infrared heater and then cooling the pavement marking materials to a temperature below about 100° F. and then peeling off the pavement marking materials from the asphalt surface.

6 Claims, No Drawings

METHOD OF REMOVING PAVEMENT MARKING MATERIALS FROM ASPHALT SURFACES

BACKGROUND OF THE INVENTION

Thermoplastic pavement marking materials have become the most widely used durable pavement markings on asphalt pavements such as asphalt roads. Preformed thermoplastic marking materials are much superior to painted marking materials since their service life is as long as the asphalt surface. These marking materials conventionally are colored thermoplastic materials, usually about 0.025 to 0.125 inches thick, normally white or yellow in color, and are used to define traffic control information, such as pedestrian walkways, the stop line for automobiles and signals for right and left turn lanes.

Such preformed marking materials are installed by two basic processes. In the case of an existing roadway or, in some cases, even in connection with a roadway that is being installed, the preformed pavement marking material is applied to the asphalt surface by means of an adhesive. This is referred to as the overlay process.

In the case of new asphalt surfacing, the accepted practice is to apply the preformed pavement marking material as a part of the final surface preparation of the asphalt roadway. The advantage of inlaying the material in this fashion results in a much greater useful life of the preformed pavement marking material and is generally referred to as the inlay process.

For a variety of reasons it is oftentimes necessary to remove preformed pavement marking material which has been applied to the pavement by either the overlay process or the inlay process.

While this invention is particularly applicable to the removal of preformed pavement marking material, and is so described herein, it also can be used for the removal of strip pavement marking material such as centerlines and edgelines.

SUMMARY OF THE INVENTION

Applicant's invention enables preformed pavement marking material to be removed from exiting pavements. Applicant's invention involves heating the surface of the asphalt roadway in which the preformed pavement marking material has been installed with infrared heaters up to a temperature just below that at which the preformed pavement marking material would liquify. Infrared heaters will not damage the hydrocarbon constituents in the pavement. Gas and liquid fuel heaters producing an open flame will destroy the pavement. The temperature used is generally about 200° F. Immediately thereafter the preformed pavement marking material is cooled down to a temperature below about 100° F. by utilizing a suitable coolant. Because of the greater mass of the pavement it will retain enough heat to maintain a temperature close to 200° F. while the preformed pavement marking material is cooled to a temperature below about 100° F. The preformed pavement marking material may then be peeled from the pavement.

It is therefore an object of this invention to provide a method whereby preformed pavement marking material may be removed from existing asphalt surfaces.

It is another object of this invention to provide a method whereby preformed pavement marking material may be removed from existing asphalt surfaces without damaging the existing asphalt surfaces.

These, together with other objects and advantages of the invention will become more readily apparent to those skilled in the art from the following detailed description.

DETAILED DESCRIPTION OF THE INVENTION

In practicing the method of the instant invention the surface of the pavement surrounding and under the preformed pavement marking material is heated by means of portable infrared heaters to a temperature which is sufficient so that the preformed pavement marking material is softened but not liquified. Usually the temperature reached does not exceed approximately 200° F.

It is important to use an infrared-type of heater so that the pavement adjacent to and under the preformed pavement marking material is heated to the same temperature and so that the pavement is not damaged.

Immediately following the heating of the preformed pavement marking material and the adjacent pavement the infrared heater is removed and a coolant is applied to the preformed pavement marking material to bring the temperature of the preformed pavement marking material down to a temperature below about 100° F. Cooling water or ice or some other coolant may be used for this purpose.

After the temperature of the preformed pavement marking

Below approximately 100° F. the material has been reduced to below approximately 100° F. the pavement below the preformed pavement marking material and adjacent thereto will have retained the heat and will have not been chilled because of its greater mass. Then the preformed pavement marking material may be merely peeled from the pavement.

While this invention has been described in its preferred embodiment, it is to be appreciated that variations therefrom may be made without departing from he true scope and spirit of the invention.

What is claimed:

1. A method of removing pavement marking material from an asphalt surface which comprises exposing the area of said asphalt surface underneath and adjacent to said pavement marking material which is to be removed to a source of infrared radiation at an energy level and for a sufficient period of time to raise the temperature of said area of said asphalt surface and said pavement marking material which is to be removed to a temperature which is just below the temperature at which said pavement marking material will melt, removing said source of infrared radiation, cooling said pavement marking material to a temperature at which said pavement marking material may be peeled from said asphalt surface, and peeling said pavement marking material from said asphalt surface.

2. The method of claim 1 wherein said asphalt surface and said pavement marking material which is to be removed are raised to a temperature just below approximately 200° F.

3. The method of claim 1 wherein said pavement marking material is cooled to a temperature below approximately 100° F.

4. The method of claim 1 wherein said pavement marking material is cooled by means of cold water.

5. The method of claim 1 wherein said pavement marking material is cooled by means of ice.

6. The method of claim 1 wherein said asphalt surface and said pavement marking material which is to be removed are heated to a temperature just below 200° F., and wherein said pavement marking material is thereafter cooled to a temperature below approximately 100° F. by using cold water as the cooling medium.

* * * * *